United States Patent [19]

Ōyama et al.

[11] 4,427,454

[45] Jan. 24, 1984

[54] METHOD FOR TREATING SUGAR SOLUTION

[75] Inventors: Yoshiyuki Ōyama, Tokyo; Yoshio Matsuo, Chiba; Hiroaki Nishi, Matsudo, all of Japan

[73] Assignee: Riken Vitamin Oil Co., Ltd., Tokyo, Japan

[21] Appl. No.: 386,217

[22] Filed: Jun. 8, 1982

[30] Foreign Application Priority Data

Jun. 26, 1981 [JP] Japan ..... 56-99175

[51] Int. Cl.[3] ..... C13D 1/00; C13G 1/04

[52] U.S. Cl. ..... 127/44; 127/42; 127/46.1; 252/321

[58] Field of Search ..... 127/42, 46.1, 44; 426/329; 252/321

[56] References Cited

U.S. PATENT DOCUMENTS

| | | | |
|---|---|---|---|
| 1,216,052 | 2/1917 | Beckman et al. | 426/329 |
| 2,727,009 | 12/1955 | Jursich | 127/44 |
| 2,871,148 | 1/1959 | Kent | 127/58 |
| 2,976,158 | 3/1961 | Morgan et al. | 426/329 |
| 3,323,923 | 6/1967 | Fiore | 426/329 |
| 3,949,098 | 4/1976 | Bangert | 426/329 X |
| 3,990,905 | 11/1976 | Wachala et al. | 127/42 X |
| 4,105,802 | 8/1978 | Cho et al. | 426/329 |

*Primary Examiner*—Kenneth M. Schor

*Attorney, Agent, or Firm*—Armstrong, Nikaido, Marmelstein & Kubovcik

[57] ABSTRACT

A method for treating a sugar solution in which one, two or more than two kinds of esters selected from the group consisting of glycerol mono-aceto mono-fatty acid ester, glycerol mono-aceto di-fatty acid ester and glycerol di-aceto mono-fatty acid ester composed of a fatty acid of 12 carbons or composed of mixed fatty acids consisting at least 40% of a fatty acid of 12 carbons and the rest being fatty acids of 8 to 14 carbons are added to the sugar solution during a process of manufacturing sugars.

4 Claims, No Drawings

METHOD FOR TREATING SUGAR SOLUTION

BACKGROUND OF THE INVENTION

This invention relates to a method for treating a sugar solution and more particularly to a sugar solution treating method in which one, two or more than two kinds of esters selected from the group consisting of glycerol mono-aceto mono-fatty acid ester, glycerol mono-aceto di-fatty acid ester and glycerol di-aceto mono-fatty acid ester composed of a fatty acid of carbon number 12 or composed of mixed fatty acids consisting at least 40% of a fatty acid of carbon number 12 and the rest being fatty acids of carbon numbers 8 to 14 are added to a sugar solution during a process of manufacturing sugars.

In a beet sugar plant, a crude cane sugar plant, a brown cane sugar plant, a regenerated brown sugar plant, a refined sugar plant, a dextrose plant, a syrup plant, an isomerized dextrose plant, etc., sugar solutions are subjected to refining process, concentration process, crystallization process, etc. For sugar manufacturing plants, the concentrating operation by evaporation of water is an important factor which affects the units of products in terms of cost accounting.

The solubility of sugars in water is high. Impurities that cannot be removed through the refining process cause a foaming phenomenon and, at the same time, the impurities not only increase the viscosity of the sugar solution but also reduce heat transmission. As the result of this, decomposition of the sugar is caused by stagnation of concentrating by evaporation and of crystallization and it results in increase of plant operating days and in increase of the fuel unit in terms of cost accounting. The loss thus induced has been immeasurable.

To solve these problems, vegetable oils such as rape seed oil, soybean oil, etc. have hitherto been used for defoaming while α-methyl glucoside fatty acid ester, sorbitan fatty acid ester, etc. have been employed as crystallization improving agents. However, the defoaming effect brought about by the conventional methods has been weak and not sufficiently durable. Meanwhile, the crystallization improving agent is not applicable to processes other than that of pan. The problems relative to defoaming, viscosity etc. thus still remain unsolved.

SUMMARY OF THE INVENTION

The present invention has found the solution of the above stated problems. It has been found through studies that these problems relative to foaming and viscosity can be solved at once by adding to the sugar solution one, two or more than two kinds of esters selected from the group consisting of glycerol mono-aceto mono-fatty acid ester, glycerol mono-aceto di-fatty acid ester and glycerol di-aceto mono-fatty acid ester (hereinafter will be called acetylated glycerides for short) which are composed of a fatty acid of carbon number 12 (12 carbon atoms) or composed of mixed fatty acids consisting at least 40% of a fatty acid of carbon number 12 and the rest being fatty acids of carbon numbers 8 to 14 (8 to 14 carbon atoms).

In accordance with the invention, the term "sugar solution" means a single aqueous solution of or a mixed aqueous solution of two or more kinds of sugars such as sucrose, dextrose, fructose, maltose, etc. and an aqueous solution of syrup.

For example, the sugar solution means any of the sugar solutions that are called juice, syrup, curing, green, washed molasses, massecuite, molasses, a solution of dextrose, an isomerized dextrose solution, a syrup solution, etc. at a beet sugar plant, a crude cane sugar plant, a refined sugar plant, a dextrose plant, an isomerized dextrose plant, a syrup plant, etc.

The fatty acid to be used for the acetylated glyceride in accordance with this invention is mainly of carbon number 12. More specifically, the fatty acid of carbon number 12 may be selected from the group consisting of fatty acids such as crude lauric acid or purified lauric acid and fatty acids of coconut oil, hardened coconut oil, palm kernel oil, hardened palm kernel oil etc.

While the acetylated glyceride to be used in accordance with the invention must mainly be composed at least 40% of the fatty acid of carbon number 12 with the rest being a mixture of fatty acids of carbon numbers 8 to 14, a slight amount of fatty acids other than these specified ones mixed in the acetylated glyceride causes no impediment in attaining the object of the invention.

The acetylated glyceride of the present invention which is mainly composed of the fatty acid of carbon number 12 greatly excels in uniform dispersibility for the sugar solution. Addition of it in a small quantity to the sugar solution gives a remarkable effect.

Meanwhile, an acetylated glyceride that is mainly composed of a saturated or unsaturated fatty acid of carbon number between 16 and 22 is inferior to that of the present invention in the dispersibility for the sugar solution.

Addition of the acetylated glyceride of the present invention to the sugar solution shows a good effect in adding quantity between 0.001 to 0.1% to the sugar solution. Adding quantity less than 0.001% does not show any sufficient effect while adding quantity exceeding 0.1% is unnecessary in terms of economy and effect.

With the acetylated glyceride according to the invention added to sugar solutions of various kinds, the viscosity of the sugar solution is lowered and foaming can be suppressed. Therefore, addition of the acetylated glyceride shows an excellent effect during concentration and crystallization processes.

Experiments were conducted in accordance with the method of the present invention. When 0.001 to 0.002% of glycerol mono-aceto di-coconut oil fatty acid ester was added to a sugar solution, the viscosity was lowered and the solution was restrained from foaming. As a result of this, it was possible to have the sugar concentration increased by 1 to 2% over the conventionally used value of sugar concentration.

Further, in lieu of rape seed oil, 0.01 o 0.02% of glycerol mono-aceto mono-lauric acid ester was added to dextrose syrup. The addition of this ester manifested a defoaming effect; accelerated heat transfer circulation; and enabled to shorten the length of time required for concentration by about one minute as compared with rape seed oil.

To a massecuite was added 0.0025 to 0.005% of glycerol di-aceto mono-hardened coconut oil fatty acid ester. The addition of this ester lowered the viscosity of the massecuite. As a result of this, it was possible to shorten the length of time required for pan boiling at least by 30%.

To a massecuite at the time of crystallizer was added about 0.002% of glycerol di-aceto mono-lauric acid ester. This addition lowered viscosity during an crystallization process to accelerate heat exchange. As a result of this, it was possible to shorten the length of time required for the crystallization process at least by 30%. Further, the viscosity of the massecuite at the crystallization still retained sufficient fluidity even when the temperature became 40°–45° C. after completion of the crystallization. This enabled a centrifugal process to be smoothly carried out without raising temperature.

The invention will be further understood from the following description of examples:

EXAMPLE 1

Viscosity Lowering and Defoaming Effects on Sugar Solutions

| Experimental No. | | Additives | Viscosity lowering rate (%) sucrose solution | Viscosity lowering rate (%) dextrose solution | Defoaming effect (foaming inhibiting rate) |
|---|---|---|---|---|---|
| 1 | Comparison example | No additive is used | 0 | 0 | 0 |
| 2 | Comparison example | α-methyl glucoside coconut oil fatty acid ester | 26.1 | 25.9 | 7.2 |
| 3 | Comparison example | Silicone preparation (content: 20%) | — | — | 20.0 |
| 4 | Comparison example | Glycerol di-aceto mono-stearic acid ester | 33.5 | 30.0 | 59.5 |
| 5 | Comparison example | Glycerol mono-aceto di-oleic acid ester | 31.2 | 28.6 | 61.3 |
| 6 | Invented method | Glycerol mono-aceto mono-lauric acid ester (lauric acid purity: 80%) | 40.6 | 37.2 | 64.0 |
| 7 | Invented method | Glycerol di-aceto mono-lauric acid ester (lauric acid purity: 62%) | 39.8 | 37.1 | 63.3 |
| 8 | Invented method | Glycerol di-aceto mono-hardened coconut oil fatty acid ester (lauric acid purity: 48%) | 38.8 | 36.5 | 64.1 |

Viscosity Lowering Rate

Both the sucrose solution and the dextrose solution were used in the state of saturated solution. Each of the additives was added to the sugar solution in quantity of 100 ppm to the sugar solution. Measurement was carried out with a rotation viscometer to obtain the value of viscosity at 60° C. The viscosity lowering rate was calculated with the viscosity of no additive (Experimental No. 1) as standard.

Defoaming Effect

Each of the additives added to a molasses (Brix 45.0°, polarization 62°) in quantity of 50 ppm. While the molasses was kept at 60° C., it was foamed over a period of 120 sec. by means of a T.K. mixer operating at 8000 rpm. The foaming inhibiting rate was calculated with the quantity of foams obtained immediately after the foaming operation of no additive as standard.

As apparent from the results of experiments thus conducted, the invented method much excels the comparison examples both in the viscosity lowering rate and the foaming inhibiting rate. The results of experiments for the dextrose solution also show similar foaming inhibiting rates.

EXAMPLE 2

Results of Sucrose Boiling Tests at a Crude Sucrose Plant

| Experimental No. | Additives | No. of test samples | Boiling time (hr) | Centrifugal time (hr) | Massecuite Brix | Massecuite sucrose purity | Massecuite reducing sugar | Green molasses Brix | Green molasses sucrose purity | Green molasses sucrose purity Drop |
|---|---|---|---|---|---|---|---|---|---|---|
| 9 | no additives | 20 | 10.98 | 4.01 | 95.2 | 60.0 | 18.6 | 87.0 | 40.1 | 19.9 |
| 10 | Comparison example* | 8 | 8.80 | 3.85 | 95.4 | 60.2 | 17.3 | 87.1 | 40.1 | 20.1 |
| 11 | Invented method** | 8 | 7.67 | 3.44 | 95.4 | 59.9 | 16.7 | 87.3 | 39.7 | 20.2 |

Notes

1. *Comparison example: Glycerol di-aceto mono-hardened soybean oil fatty acid ester was added in quantity 100 ppm against the weight of a boiling massecuite.
2. **Invented method: Glycerol di-aceto mono-hardened coconut oil fatty acid ester was added in quantity 80 ppm against the weight of a boiling massecuite.
3. Sucrose purity $= \frac{\text{Total sucrose content}}{\text{Total sucrose solution solid content}} \times 100$

Comparison between the Acetylated Glyceride Addition Area and a Non-addition Area The extents of changes that took place in the addition area were obtained with the values of the non-addition area used as standard. Experimental No. 12 is same as Experimental 10, and Experimental No. 13 same as Experimental 11.

| Experimental No. | | Boiling time | centrifugal time | Reducing sugar | sucrose purity Drop |
|---|---|---|---|---|---|
| 12 | Comparison example | Shortened by 19.9% | Shortened by 4.0% | Decreased 7.0% | Increased 1.0% |
| 13 | Invented method | Shortened by 30.1% | Shortened by 14.2% | Decreased 10.2% | Increased 1.5% |

As will be clearly understood from these results, compared with the non-addition example and the comparison example, the method of the present invention greatly shortens the boiling time and the centrifugal time thus showing the excellent effect thereof.

What is claimed is:

1. A method for treating a sugar solution, comprising adding an ester composition to the sugar solution during a process of manufacturing sugars, in an amount which is sufficient to defoam the sugar solution and reduce its viscosity and which is at least 0.001% of the sugar solution, wherein the ester composition comprises one, two or more than two kinds of esters selected from the group consisting of glycerol mono-aceto mono-fatty acid ester, glycerol mono-aceto di-fatty acid ester and glycerol di-aceto mono-fatty acid ester, where the esters of the ester composition have a fatty acid of 12 carbons or have mixed fatty acids consisting of at least 40% of a fatty acid of 12 carbons, the rest being fatty acids of 8 to 14 carbons.

2. The method for treating a sugar solution according to claim 1 wherein the sugar solution is selected from a solution of one or more kinds of sucrose, dextrose, fructose and maltose.

3. The method for treating a sugar solution according to claim 1 wherein the fatty acid of glycerol mono-aceto mono-fatty acid ester, glycerol mono-aceto di-fatty acid ester and glycerol di-aceto mono-fatty acid ester is consisting of crude lauric acid, purified lauric acid and fatty acids of coconut oil, palm kernel oil, hardened coconut oil and hardened palm kernel oil.

4. The method for treating a sugar solution according to claim 1 or claim 3 wherein the added quantity of glycerol mono-aceto mono-fatty acid ester, glycerol mono-aceto di-fatty acid ester and glycerol di-aceto mono-fatty acid ester is between 0.001 and 0.1% of the sugar solution.

* * * * *